US008870167B2

(12) United States Patent
Hardison

(10) Patent No.: US 8,870,167 B2
(45) Date of Patent: Oct. 28, 2014

(54) FLUID AERATOR

(76) Inventor: John Charles Hardison, Las Vegas, NV (US)

( * ) Notice: Subject to any disclaimer, the term of this patent is extended or adjusted under 35 U.S.C. 154(b) by 172 days.

(21) Appl. No.: 13/290,184

(22) Filed: Nov. 7, 2011

(65) Prior Publication Data

US 2012/0280410 A1 Nov. 8, 2012

Related U.S. Application Data

(60) Provisional application No. 61/410,402, filed on Nov. 5, 2010.

(51) Int. Cl.

| | |
|---|---|
| ***B01F 3/04*** | (2006.01) |
| ***B01F 13/00*** | (2006.01) |
| *B01F 5/06* | (2006.01) |

(52) U.S. Cl.

CPC ..... *B01F 3/0446* (2013.01); *B01F 2005/0637* (2013.01); *B01F 13/002* (2013.01); *B01F 5/0619* (2013.01); *B01F 2215/007* (2013.01)

USPC ..... 261/108; 222/567; 99/323.1; 426/474

(58) Field of Classification Search

USPC ..... 261/78.2, 108, 110; 222/190, 566, 567; 99/323.1; 426/474

See application file for complete search history.

(56) References Cited

U.S. PATENT DOCUMENTS

| | | | | |
|---|---|---|---|---|
| 6,568,660 | B1 * | 5/2003 | Flanbaum | 261/76 |
| 2013/0202757 | A1 * | 8/2013 | Hawkins | 426/474 |

* cited by examiner

*Primary Examiner* — Robert A Hopkins
(74) *Attorney, Agent, or Firm* — John M. Behles

(57) ABSTRACT

A fluid aerator connectable to the neck of a container holding a fluid, the fluid aerator having a tubular body having one end adapted to sealingly connect to the neck of the container, a plurality of mixing elements disposed within the tubular body, and wherein when the fluid aerator is attached to the neck of the container and fluid is dispensed from the container, ambient air is drawn into the tubular body and mixes with fluid as it passes over the plurality of mixing elements to aerate the fluid.

20 Claims, 4 Drawing Sheets

FLUID AERATOR

CROSS-REFERENCE TO RELATED APPLICATION(S)

This nonprovisional patent application claims the benefit of provisional U.S. Patent Application Ser. No. 61/410,402, filed on Nov. 5, 2010, entitled "FLUID AERATOR"—which is hereby incorporated by reference in its entirety.

BACKGROUND OF THE INVENTION

1. Field of the Invention

The present technology relates in general a fluid aerator, and more particularly, but not by way of limitation, to a fluid aerator which is adapted to interface with a container, wherein the fluid aerator is constructed to aerate fluid dispensed from the container and wherein the aerator is substantially drip free during use and when the container is placed in a standing position.

2. Background Art

Fluid aerators, particularly those for use in aerating wine, have been known in the art for years. While fluid aerators have been known in the art for years, their configurations remain non-desirous and/or problematic inasmuch as, among other things, none appear to be configured to interface with the outside of the container and to function in a substantially drip free manner during use and when the container is placed in a standing position.

It is therefore an object of the present technology to provide a fluid aerator, which, among other things, remedies the detriments and/or complications associated with the use of conventional fluid aerators. It is further therefore an object of the present technology to provide a fluid aerator which is adapted to interface with a container, wherein the fluid aerator is constructed to aerate fluid dispensed from the container wherein the aerator is substantially drip free during use and when the container is placed in a standing position.

These and other objects of the present technology will become apparent in light of the present specification, claims, and drawings.

SUMMARY OF THE INVENTION

In one embodiment, the present technology is directed to a fluid aerator connectable to the neck of a container holding a fluid, the fluid aerator comprising: (a) a tubular body having one end adapted to sealingly connect to the neck of the container; (b) a plurality of mixing elements disposed within the tubular body; and (c) wherein when the fluid aerator is attached to the neck of the container and fluid is dispensed from the container, ambient air is drawn into the tubular body and mixes with fluid as it passes over the plurality of mixing elements to aerate the fluid.

In another embodiment, the plurality of mixing elements extend radially around a shaft, wherein the shaft is connectable to the tubular body.

In yet another embodiment, the plurality of mixing elements are spaced apart from one another and adjacent mixing elements extend from the shaft in opposing directions.

In accordance with the present technology, the shaft is tubular and provides a path for the communication of fluids into the container.

In one embodiment, the shaft includes a strut intersecting a terminal end of the shaft, the strut having ends adapted to cooperate with grooves fabricated onto the tubular body for releaseably connecting the shaft to the tubular body.

In another embodiment, the fluid aerator further comprises a tubular extension releaseably connectable to the shaft providing a path for the communication of fluids into the container.

In yet another embodiment, at least one of the mixing elements extends around the shaft in a helical fashion.

In accordance with the present disclosure, two or more of the mixing elements extends around the shaft in a helical fashion, and wherein adjacent helical mixing elements are rotationally offset from one another.

In one embodiment, the tubular body includes a tubular rubber sleeve sized to overlap at least a portion of the neck of the container.

In an additional embodiment, the fluid aerator further comprises a securement member for sealingly connecting the tubular rubber sleeve to the neck of the container.

In another embodiment, the tubular body is adapted to be sealingly inserted into the neck of the container.

In another embodiment, the present technology is directed to a fluid aerator adapted to attach to the neck of a container, the fluid aerator comprising: (a) a connector assembly, the connector assembly comprising: (i) a container interface portion for sealingly connecting the connector assembly to the neck of the container; (b) a tubular body extending from the connector assembly; (b) an insert adapted to be releaseably received within the tubular body, the insert comprising: (i) a shaft releaseably connectable to the tubular body; (ii) a plurality of elements extending from the shaft; (c) wherein when the fluid aerator is attached to the neck of the container and fluid is dispensed from the container, ambient air is drawn into the tubular body and mixes with fluid as it passes over the plurality of mixing elements to aerate the fluid.

In an additional embodiment, the plurality of mixing elements are spaced apart from one another and adjacent mixing elements extend from the shaft in opposing directions.

In accordance with the present disclosure, the shaft is tubular and provides a path for the communication of fluids into the container.

In yet another embodiment, the shaft includes a strut intersecting a terminal end of the shaft, the strut having ends adapted to cooperate with grooves fabricated onto the tubular body for releaseably connecting the shaft to the tubular body.

In accordance with the present technology, the fluid aerator further comprises a tubular extension releaseably connectable to the shaft providing a path for the communication of fluids into the container.

In yet another embodiment, at least one of the mixing elements extends around the shaft in a helical fashion.

In an additional embodiment, two or more of the mixing elements extends around the shaft in a helical fashion, and wherein adjacent helical mixing elements are rotationally offset from one another.

In accordance with the present technology, the tubular body includes a tubular rubber sleeve sized to overlap at least a portion of the neck of the container.

In yet another embodiment, the fluid aerator further comprises a securement member for sealingly connecting the tubular rubber sleeve to the neck of the container.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive may be omitted. It will be understood that the technology is not necessarily limited to the particular embodiments illustrated herein.

The present technology will now be described with reference to the drawings wherein.

DETAILED DESCRIPTION OF THE INVENTION

Figure 1:
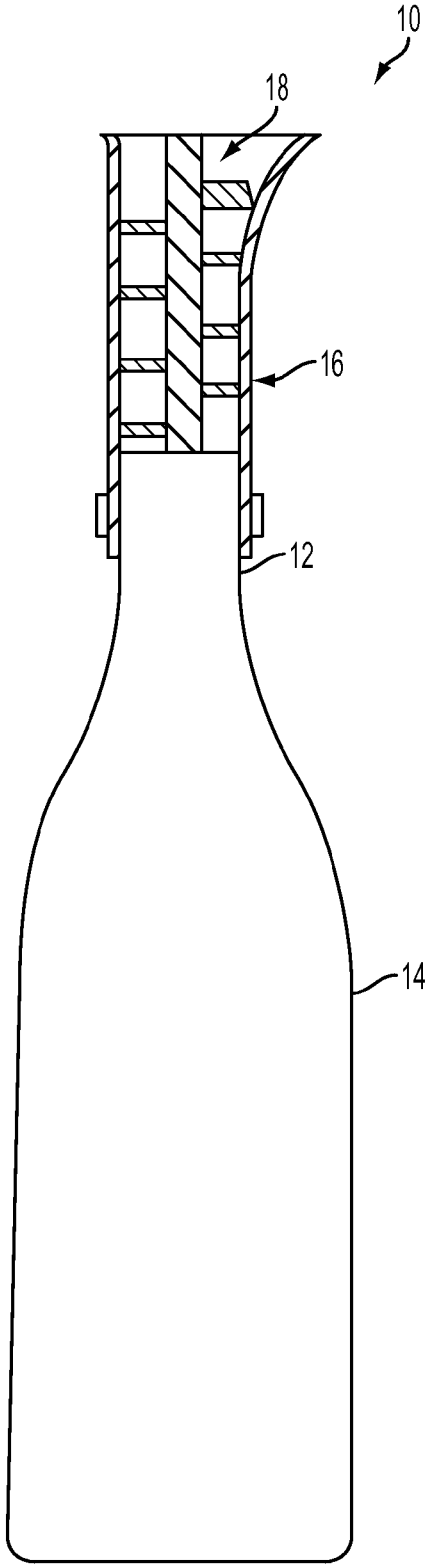
FIG. 1 of the drawings is a cross-sectional, side elevation view of a fluid aerator attached to a container, constructed in accordance with the present technology.

While the present technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

It will be understood that like or analogous elements and/or components, referred to herein, may be identified throughout the drawings with like reference characters.

Referring now to the drawings, and more particularly to FIG. 1, shown therein is fluid aerator 10. In some embodiments, fluid aerator 10 is adapted to interface with the outside surface of neck 12 of container 14, which may include a wine bottle. Fluid aerator 10 functions to aerate the fluid contained within container 14 as it is poured from container 14.

Figure 2:
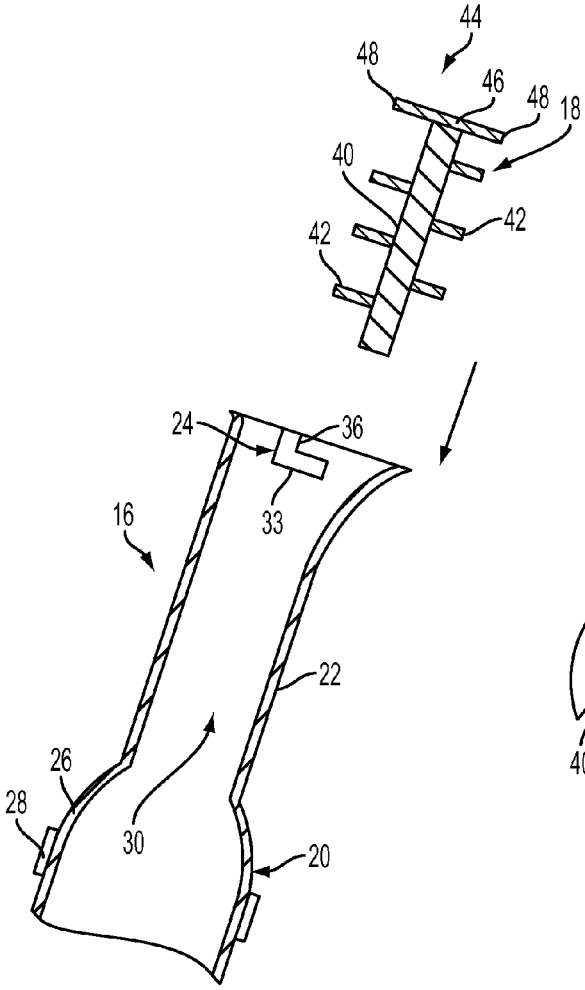
FIG. 2 is an exploded perspective view of the fluid aerator of FIG. 1 showing a connector assembly in cross section.

Referring now to FIG. 2, in general, fluid aerator 10 includes connector assembly 16 and insert 18. Connector assembly 16 is an elongated tubular member having container interface portion 20, body 22, and insert interface 24. Portions of connector assembly 16 such as body 22 are preferably fabricated from a strong and rigid material such as metals, non-metals, ceramics, wood, plastics, stainless steel or other acceptable metals, glass, composite material, etcetera.

By way of non-limiting example, container interface portion 20 may include a tubular rubber sleeve 26 surrounded at least partially by securement member 28. Rubber sleeve 26 is preferably sized to fit over neck 12 of container 14. Rubber sleeve 26 may be secured to neck 12 of container 14 via securement member 28. Securement member 28 operates to sealingly connect, that is, create a watertight seal around neck 12 to prevent spillage from container 14. Securement member 28 may include, for example, a clamp, a tie, a clip, or the like, although it will be understood that one of ordinary skill in the art will appreciate that many different methods for sealingly connecting container interface portion 20 to container 14 would also likewise be contemplated for use in accordance with the present technology.

Body 22 extends monolithically from, or is attached to container interface portion 20 and provides support for insert 18. More specifically, body 22 forms a sleeve which defines passage 30 that functions as the mixing chamber for combining ambient air with fluid poured from container 14, as will be discussed in greater detail below. Body 22 transitions at one end to pour spout 32. The size and shape of pour spout 32 will vary according to design requirements, such as desired aeration, flow rate, and the like. Body 22 may also include one or more notches or grooves 34 for receiving one or more tabs associated with insert 18 for releaseably securing insert 18 to body 22. In some embodiments, grooves 34 are substantially L-shaped having a vertical portion 36 and a horizontal portion 38 configured to allow the tabs of insert 18 to travel within grooves 34.

Figure 3:
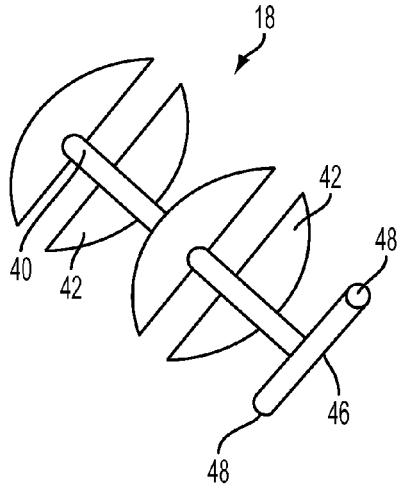
FIG. 3 is a perspective view of an insert of the fluid aerator.

Referring now to FIGS. 2 and 3 collectively, insert 18 in combination with body 22 acts as a static mixer that combines fluids contained within container 14 with ambient air from outside container 14 as fluid is poured from container 14. In some embodiments, insert 18 is provided with solid shaft 40 and a plurality of mixing elements 42 resembling fins (also known as static mixing elements). The shaft 40 includes terminal end 44 that is adapted to interface with grooves 34 of body 22 for releaseably connecting insert 18 to body 22. More specifically, terminal end 44 includes strut 46 having tabs 48 disposed on either end of strut 46. Tabs 48 are sized to be received within grooves 34 of body 22. Insert 18 may be releaseably locked to body 22 by inserting tabs 46 into vertical portion 36 of grooves 34, sliding insert 18 downwardly within body 22 and turning insert 18 to cause tabs 48 to displace into horizontal portions 38 of grooves 34.

In other embodiments, mixing elements 42 are provided as hemispherical fins that extend outwardly from shaft 40. Mixing elements 42 are spaced apart from one another and are oriented such that adjacent elements 42 extend from shaft 40 in opposite directions from one another. It will be understood that elements 43 may be staggered in varying patterns to change the degree of aeration of the fluid. It will be further understood that some elements 42 may be helical or otherwise shaped, or may form helical patterns (configurations) along shaft 40 to increase aeration of fluid passing through fluid aerator 10. Although not shown, helical elements may be radially offset from one another to further divide flow as necessary. The design and use of static mixers, in particular the maximization of aeration for particular applications is commonly known to those of ordinary skill in the art and therefore, will not be discussed in any further detail.

In operation, container interface portion 20 of fluid aerator 10 is placed over neck 12 of container 14. Next, securement member 28 is engaged to sealingly secure fluid aerator 10 to container 14. After fluid aerator 10 is secured to container 14, insert 18 is inserted into body 22 such that tabs 48 of strut 46 of insert 18 are axially aligned with vertical portions 36 of grooves 34. Insert 18 is then slid downwardly and twisted to displace tabs 48 of strut 46 into horizontal portions 38 of grooves 34 to lock insert 18 in place. Once fluid aerator 10 has been joined to container 14, fluid may be dispensed from container 14. As fluid is dispensed, ambient air is drawn into passage 30 mixing with the fluid as it passes over and/or around mixing elements 42, aerating the fluid.

Figure 4:
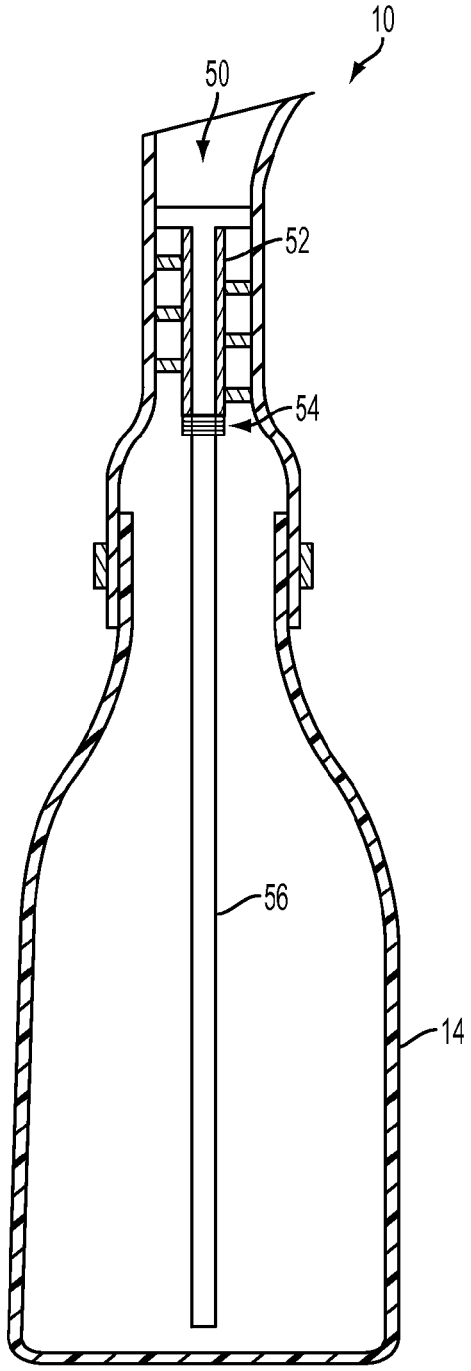
FIG. 4 is a cross-sectional, side elevation view of a fluid aerator having an alternative insert with a hollow shaft.

Referring now to FIG. 4, shown therein is fluid aerator 10 with an alternative insert 50. Insert 50 allows for adequate aeration of fluids in both low and high flow applications. More specifically, insert 50 is constructed identically to insert 18 with the exception that shaft 52 is hollow for providing communication of fluids such as ambient air into container 14. When fluid is poured from container 14, ambient air is communicated into container 14 via shaft 52 enhancing aeration of the fluid flowing through fluid aerator 10 and increasing the driving force of the fluid poured from the container 14. Increasing the driving force of the fluid causes the fluid to pass over mixing elements 42 with greater force, thereby leading to increased aeration.

In some embodiments, fluid aerator 10 is provided with tubular extension 56 for enhancing aeration of the fluid flowing through fluid aerator 10. Terminal end 54 of shaft 52 is adapted to releaseably connect to tubular extension 56. In other embodiments, terminal end 54 of shaft 52 is provided with threads that cooperate with threads on tubular extension 56.

Tubular extension 56 provides fluid communication of ambient air from outside container 14 to the bottom portion of container 14 to enhance the flow of fluid from container 14 and therefore enhance aeration of the fluid flowing through fluid aerator 10. Additionally, tubular extension 56 increases the driving force of the fluid poured from container 14. Tubular extension 56 is particularly suited for low flow situations, such when pouring fluid from container 14 that is substantially full of fluid, although it will be understood that tubular extension 56 may likewise be utilized applications with any flow rate.

Figure 5:
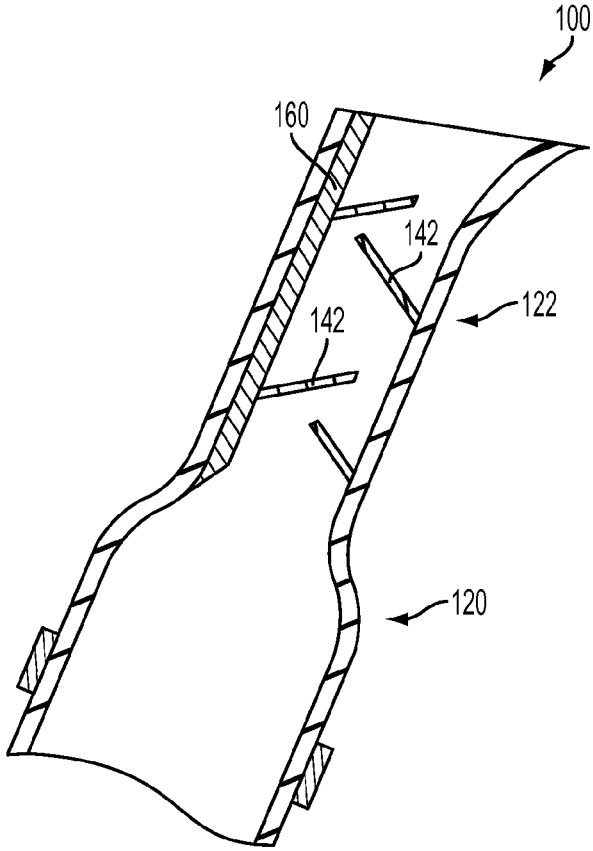
FIG. 5 is a cross-sectional, side elevation view of an alternative embodiment of a fluid aerator.

Referring now to FIG. 5, shown therein is an alternative embodiment of fluid aerator 10, hereinafter referred to as fluid aerator 100. Similarly to fluid aerator 10, fluid aerator 100 is adapted to connect to a container (not shown) via container interface portion 120 and securement member 128. Body 122 is constructed similarly to body 22 of fluid aerator 10 except that body 122 is fabricated with tubular air bypass 160 providing communication of fluids such as ambient air from outside the container into the container to be mixed with fluid as it is poured from the container.

Mixing elements 142 are constructed and shaped similarly to mixing elements 42 of fluid aerator 10, but in contrast to fluid aerator 10, mixing elements 142 extend from the inner surface of body 122. Mixing elements 142 are spaced apart from one another and in one embodiment mixing elements are disposed at angles. In one non-limiting example, adjacent mixing elements 142 may have alternating short and long lengths. It will be understood that the spacing, thickness, orientation, angle, and the like of mixing elements 142 may vary according to design constraints such as desired fluid flow, aeration, and the like.

The foregoing description merely explains and illustrates the present technology and the present technology is not limited thereto except insofar as the appended claims are so limited, as those skilled in the art who have the disclosure before them will be able to make modifications without departing from the scope of the present technology.

What is claimed is:

1. A fluid aerator connectable to a neck of a container holding a fluid, the fluid
aerator comprising:
- a tubular body having one end adapted to sealingly connect to the neck of the container;
- a plurality of mixing elements disposed within the tubular body; and
- wherein when the fluid aerator is attached to the neck of the container and fluid is dispensed from the container, ambient air is drawn into the tubular body and mixes with fluid as it passes over the plurality of mixing elements to aerate the fluid.

2. The fluid aerator of claim 1, wherein each of the plurality of mixing elements extends radially around at least a portion of a shaft, wherein the shaft is connectable to the tubular body.

3. The fluid aerator of claim 2, wherein the plurality of mixing elements are spaced apart from one another and adjacent mixing elements extend from the shaft in opposing directions.

4. The fluid aerator of claim 3, wherein the shaft is tubular and provides a path for communication of air into the container.

5. The fluid aerator of claim 4, wherein the shaft includes a strut intersecting a terminal end of the shaft, the strut having ends adapted to cooperate with grooves fabricated onto the tubular body for releaseably connecting the shaft to the tubular body.

6. The fluid aerator of claim 4, further comprising a tubular extension releaseably connectable to the shaft, the tubular extension having a terminal end that is disposed proximate a bottom of the container when the tubular extension is attached to the shaft.

7. The fluid aerator of claim 4, wherein at least one of the mixing elements extends around the shaft in a helical configuration.

8. The fluid aerator of claim 4, wherein two or more of the mixing elements extend around the shaft in a helical configuration, and wherein adjacent helical mixing elements are offset from one another.

9. The fluid aerator of claim 1, wherein the tubular body is sized to overlap at least a portion of the neck of the container.

10. The fluid aerator of claim 9, further comprising a securement member for sealingly connecting a tubular rubber sleeve to the neck of the container.

11. The fluid aerator of claim 1, wherein the tubular body includes a pour spout.

12. A fluid aerator adapted to attach to a neck of a container, the fluid aerator comprising:
- a connector assembly, the connector assembly comprising:
- a container interface portion for sealingly connecting the connector assembly to the neck of the container;
- a tubular body extending from the connector assembly;
- an insert adapted to be releaseably received within the tubular body, the insert comprising:
- a shaft releaseably connectable to the tubular body;
- a plurality of mixing elements extending from the shaft;
- wherein when the fluid aerator is attached to the neck of the container and fluid is dispensed from the container, ambient air is drawn into the tubular body and mixes with fluid as it passes over the plurality of mixing elements to aerate the fluid.

13. The fluid aerator of claim 12, wherein the plurality of mixing elements are spaced apart from one another and adjacent mixing elements extend from the shaft in opposing directions.

14. The fluid aerator of claim 13, wherein the shaft is tubular and provides a path for the communication of fluids into the container.

15. The fluid aerator of claim 12, wherein the shaft includes a strut intersecting a terminal end of the shaft, the strut having ends adapted to cooperate with grooves fabricated onto the tubular body for releaseably connecting the shaft to the tubular body.

16. The fluid aerator of claim 14, further comprising a tubular extension releaseably connectable to the shaft providing a path for communication of fluids into the container.

17. The fluid aerator of claim 12, wherein at least one of the mixing elements extends around the shaft in a helical configuration.

18. The fluid aerator of claim 12, wherein two or more of the mixing elements extend around the shaft in a helical configuration, and wherein adjacent helical mixing elements are rotationally offset from one another.

19. The fluid aerator of claim 12, wherein the tubular body includes a tubular rubber sleeve sized to overlap at least a portion of the neck of the container.

20. The fluid aerator of claim 19, further comprising a securement member for sealingly connecting the tubular rubber sleeve to the neck of the container.

* * * * *